US011854514B2

(12) United States Patent
Gorman et al.

(10) Patent No.: US 11,854,514 B2
(45) Date of Patent: Dec. 26, 2023

(54) DRUMHEAD WITH REDUCED VOLUME

(71) Applicant: D'Addario & Company, Inc., Farmingdale, NY (US)

(72) Inventors: Ryan Gorman, Knightstown, IN (US); Richard Stillwell, Melville, NY (US); Paul Pearl, Melville, NY (US); Sergio Bonsignore, Ridgewood, NY (US); Tyler Burke, Wantagh, NY (US); Randy Beck, Clayton, MO (US)

(73) Assignee: D'Addario & Company, Inc., Farmingdale, NY (US)

( * ) Notice: Subject to any disclaimer, the term of this patent is extended or adjusted under 35 U.S.C. 154(b) by 275 days.

(21) Appl. No.: 17/077,275

(22) Filed: Oct. 22, 2020

(65) Prior Publication Data

US 2021/0125590 A1 Apr. 29, 2021

Related U.S. Application Data

(60) Provisional application No. 62/924,720, filed on Oct. 23, 2019.

(51) Int. Cl.
*G10D 13/02* (2020.01)
*G10D 13/24* (2020.01)
(Continued)

(52) U.S. Cl.
CPC ..... *G10D 13/02* (2013.01); *G10D 13/16* (2020.02); *G10D 13/20* (2020.02); *G10D 13/24* (2020.02)

(58) Field of Classification Search
CPC ..... G10D 13/24; G10D 13/20; G10D 13/02
See application file for complete search history.

(56) References Cited

U.S. PATENT DOCUMENTS 729,936 A * 6/1903 Heybeck ..... G10D 13/20 84/414
3,250,169 A * 5/1966 Stone, Jr. ..... G10D 13/20 84/411 R
(Continued)

FOREIGN PATENT DOCUMENTS

CN 2716961 Y 8/2005
FR 1383434 2/1964
(Continued)

OTHER PUBLICATIONS

"Remo Silent Stroke Mesh Drum Head," Steve Weiss Music, Inc., retrieved from https://www.steveweissmusic.com/product/remo-silent-stroke-mesh-drumheads/mesh-drum-heads on Dec. 26, 2018.
(Continued)

*Primary Examiner* — Robert W Horn
(74) *Attorney, Agent, or Firm* — Alix, Yale & Ristas, LLP

(57) ABSTRACT

A reduced volume drumhead has a layer of porous material and a ring of compressible material. The ring of compressible material is fixed to the underside of the layer of porous material in a substantially centered or coaxial position with the porous material stretched across a hoop in tension. The ring may be formed of a foam or similar material with compressibility and stretchability under tension and defines an open central area of the drumhead for striking. The ring may be formed of segments and thus include one or more circumferential breaks with spacing. The drumhead provides natural tonal characteristics and has a natural feel when struck.

21 Claims, 3 Drawing Sheets

(51) Int. Cl.
*G10D 13/20* (2020.01)
*G10D 13/16* (2020.01)

(56) References Cited

U.S. PATENT DOCUMENTS

| | | | | |
|---|---|---|---|---|
| 3,425,309 | A | 2/1969 | Elzas et al. | |
| 4,244,266 | A * | 1/1981 | Hardy | G10D 13/02 84/411 M |
| 4,254,685 | A * | 3/1981 | Rose | G10D 13/20 84/414 |
| 4,282,011 | A | 8/1981 | Terpay | |
| 4,325,280 | A * | 4/1982 | Hardy | G10D 13/14 84/411 M |
| 4,362,081 | A | 12/1982 | Hartry | |
| 4,770,918 | A | 9/1988 | Hayashi | |
| 4,798,121 | A * | 1/1989 | Donohoe | G10D 13/02 84/414 |
| 4,828,907 | A | 5/1989 | Hayashi | |
| 5,561,254 | A * | 10/1996 | Huffer | G10D 13/02 84/411 M |
| 5,892,168 | A * | 4/1999 | Donohoe | G10D 13/02 84/411 M |
| 5,920,021 | A * | 7/1999 | Good | G10D 13/02 84/411 M |
| 5,920,026 | A | 7/1999 | Yoshino et al. | |
| 5,998,716 | A | 12/1999 | Marquez et al. | |
| 6,365,812 | B1 | 4/2002 | McGill | |
| 6,518,490 | B2 * | 2/2003 | Good | G10D 13/02 84/414 |
| 6,525,249 | B1 | 2/2003 | Suenaga | |
| 6,756,535 | B1 | 6/2004 | Yoshino et al. | |
| 6,921,857 | B2 | 7/2005 | Yoshino et al. | |
| 7,214,867 | B1 * | 5/2007 | Gatzen | G10D 13/02 84/411 R |
| 7,439,432 | B2 | 10/2008 | Hiraku | |
| 7,465,869 | B1 | 12/2008 | Freitas | |
| 7,476,794 | B2 * | 1/2009 | May, Jr. | G10D 13/10 84/411 R |
| 7,498,500 | B2 | 3/2009 | Rogers | |
| 7,514,617 | B2 | 4/2009 | Rogers et al. | |
| 7,569,758 | B2 | 8/2009 | Harada et al. | |
| 7,667,130 | B2 | 2/2010 | Mishima | |
| 7,781,661 | B2 | 8/2010 | Rogers et al. | |
| 7,795,519 | B2 | 9/2010 | Hsien | |
| 8,148,619 | B1 * | 4/2012 | May | G10D 13/14 84/411 M |
| RE43,885 | E | 1/2013 | Rogers et al. | |
| 8,895,827 | B1 * | 11/2014 | Grossman | G10D 13/02 84/411 M |
| 8,933,310 | B2 | 1/2015 | Rogers | |
| 9,159,305 | B1 * | 10/2015 | Mazzarisi | G10D 13/10 |
| 9,190,037 | B2 * | 11/2015 | May | G10D 13/14 |
| 9,190,040 | B2 * | 11/2015 | Hashimoto | G10D 13/22 |
| 9,257,107 | B1 * | 2/2016 | Belli | G10D 13/20 |
| 9,349,356 | B2 | 5/2016 | Yoshino | |
| 9,437,177 | B2 | 9/2016 | Chiappe | |
| 9,472,175 | B2 | 10/2016 | Wada et al. | |
| 9,601,095 | B2 | 3/2017 | Tanabe | |
| 9,959,849 | B2 | 5/2018 | Abe et al. | |
| 9,978,350 | B1 | 5/2018 | Lin | |
| 10,102,833 | B1 | 10/2018 | May | |
| 10,235,978 | B2 | 3/2019 | Bean et al. | |
| 10,475,424 | B2 | 11/2019 | Motohashi et al. | |
| 10,726,817 | B1 | 7/2020 | McIntyre | |
| 10,885,887 | B2 * | 1/2021 | Hanson | B32B 5/26 |
| 2006/0065099 | A1 * | 3/2006 | Anderson | G10D 13/06 84/411 M |
| 2008/0148921 | A1 | 6/2008 | Calder | |
| 2013/0042744 | A1 * | 2/2013 | Hsien | G10D 13/20 84/414 |
| 2013/0312585 | A1 * | 11/2013 | Yunbin | G10D 13/20 84/414 |
| 2015/0082967 | A1 | 3/2015 | Yoshino | |
| 2018/0137843 | A1 | 5/2018 | Roderick | |
| 2019/0035369 | A1 | 1/2019 | Roderick | |
| 2019/0295516 | A1 | 9/2019 | Hashimoto et al. | |
| 2020/0211515 | A1 | 7/2020 | Yoshino | |
| 2020/0342839 | A1 | 10/2020 | Hanson | |
| 2020/0402484 | A1 * | 12/2020 | Tanabe | G10D 13/02 |
| 2021/0125590 | A1 * | 4/2021 | Gorman | G10D 13/02 |

FOREIGN PATENT DOCUMENTS

| | | | |
|---|---|---|---|
| JP | 2015052716 | A | 3/2015 |
| WO | 2019114312 | A1 | 6/2019 |

OTHER PUBLICATIONS

"Zed MAPW20 20 Inch Single Ply Mesh Drum Head," retrieved from https://reverb.com/item/6053662-zed-mapw20-20-inch-single-ply-mesh-drum-head on Dec. 27, 2018.

* cited by examiner

DRUMHEAD WITH REDUCED VOLUME

CROSS-REFERENCE TO RELATED APPLICATION

This application claims priority to U.S. Provisional Patent Application No. 62/924,720 for "Drumhead with Reduced Volume," filed on Oct. 23, 2020, the entire contents of which are incorporated herein by reference.

BACKGROUND

The disclosed embodiments relate to drums, and, in particular, to a drumhead for a drum that produces an authentic natural acoustic tone with reduced volume compared to standard drums of the same type.

A common or "standard" drum, such as a tom drum, produces a sound at full volume, typically above 100 dBA. Having recognized issues with full volume in certain circumstance, the industry has developed drums and drumheads that are considered "low volume," which heretofore have been used essentially only in practice settings. Known low volume drumheads fail to accurately emulate the natural tonal characteristics of a standard drum and are too quiet for use in performance settings. Further, many drummers report that the response to striking a low volume drumhead, which is typically made from mesh material or a similar porous fabric, does not feel natural as the drumstick bounces more intensely and in different directions. This is commonly referred to in the musical field as the "trampoline effect" of mesh drumheads.

There are many settings or situations in which drummers desire the natural sound of a drum, such as a tom drum or a bass drum, at a reduced volume that is lower than standard volume, but more audible than low volume and suitable for performance settings, while not sacrificing natural tonal characteristics. A solution that cures these deficiencies while also providing a feel that is more like that of a standard full volume drumhead but with a reduced volume would thus be useful.

SUMMARY

An embodiment of the disclosed drumhead with reduced volume includes a layer of a porous material, which may be a mesh, with a ring of a compressible material, such as a foam. The ring is adhered to a surface of the porous material.

In another embodiment of the drumhead with reduced volume, a layer of a porous material is stretched across a substantially circular hoop and defines a first surface and second surface. A ring of a foam material is adhered to the second surface of the porous material substantially coaxial to the hoop. When the drumhead is struck, it exhibits a reduction in sound pressure of approximately 50-95% and a reduction in sound level compared to a standard drumhead of the same size and shape when tested in a semi-anechoic studio environment with a dBA-weighted decibel reader.

In yet another embodiment of the disclosed drumhead with reduced volume, a layer of a porous material is stretched in tension and defines a first surface and second surface. A unit of a foam material is adhered to the second surface in a substantially centrally located position. The unit of foam material defines an inner portion of the layer of a porous material. When the drumhead is struck on the first surface in a location within the inner portion, the drumhead exhibits a reduction in sound level of approximately 5-25 dB and a reduction in sound pressure of approximately 50-95% compared to a standard drumhead of the same size and shape when tested in a semi-anechoic studio environment with a dBA-weighted decibel reader.

DISCLOSURE OF THE INVENTION

Among the benefits and improvements disclosed herein, other objects and advantages of the disclosed embodiments will become apparent from the following wherein like numerals represent like parts throughout the several figures. Detailed embodiments of a drumhead with reduced volume are disclosed; however, it is to be understood that the disclosed embodiments are merely illustrative of the invention that may be embodied in various forms. In addition, each of the examples given in connection with the various embodiments of the invention which are intended to be illustrative, and not restrictive.

Throughout the specification and claims, the following terms take the meanings explicitly associated herein, unless the context clearly dictates otherwise. The phrase "in some embodiments" as used herein does not necessarily refer to the same embodiment(s), though it may. The phrases "in another embodiment" and "in some other embodiments" as used herein do not necessarily refer to a different embodiment, although it may. Thus, as described below, various embodiments may be readily combined, without departing from the scope or spirit of the invention.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on".

Further, the terms "substantial," "substantially," "similar," "similarly," "analogous," "analogously," "approximate," "approximately," and any combination thereof mean that differences between compared features or characteristics is less than 25% of the respective values/magnitudes in which the compared features or characteristics are measured and/or defined.

Figure 1:
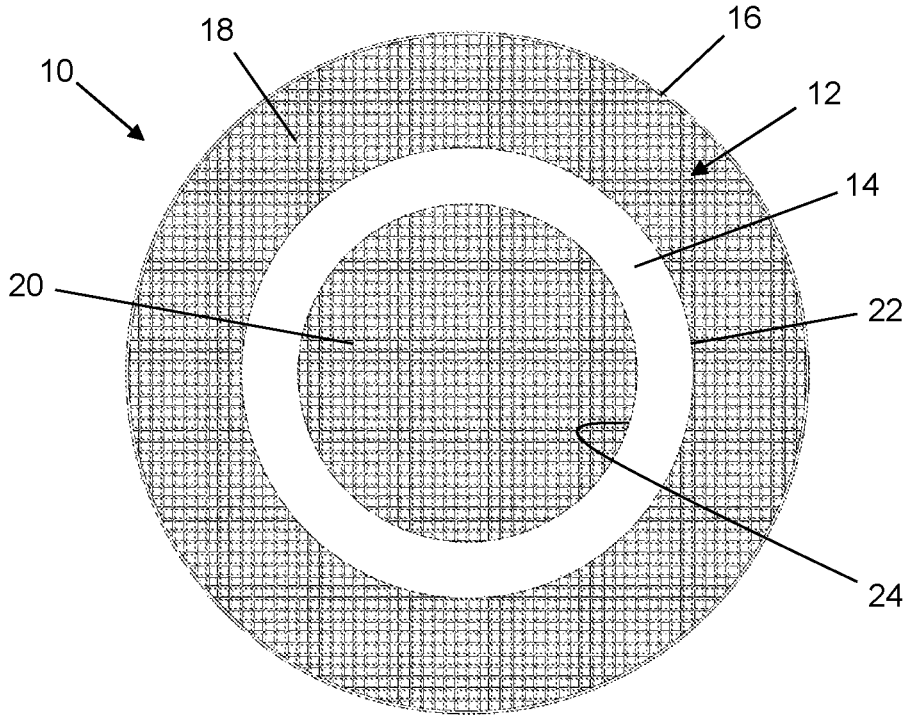
FIG. 1 is a view from the underside of the disclosed drumhead with reduced volume formed by a porous mesh layer and a cylindrical foam ring.
Figure 2:
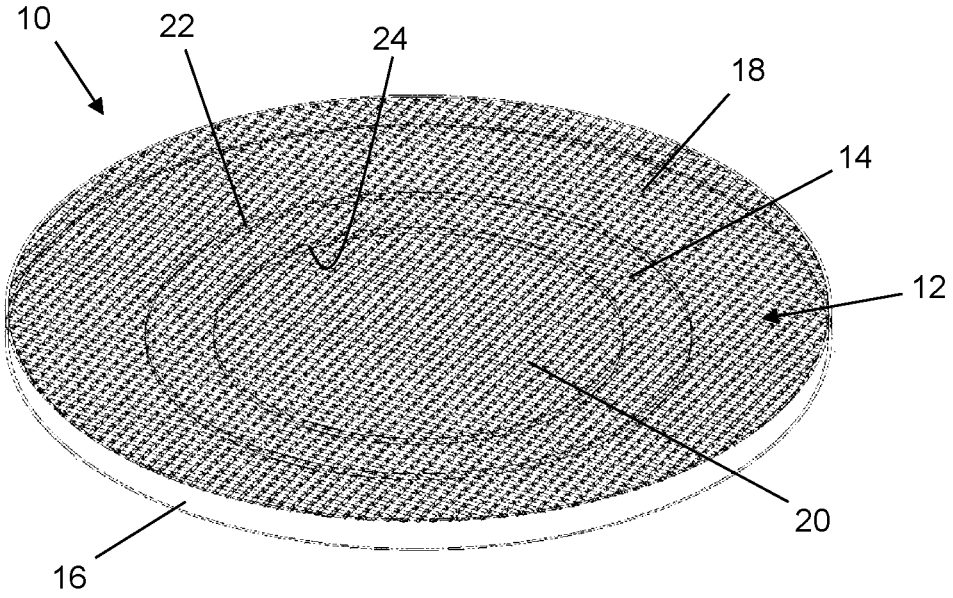
FIG. 2 is a top perspective view of the drumhead of FIG. 1.
Figure 3:
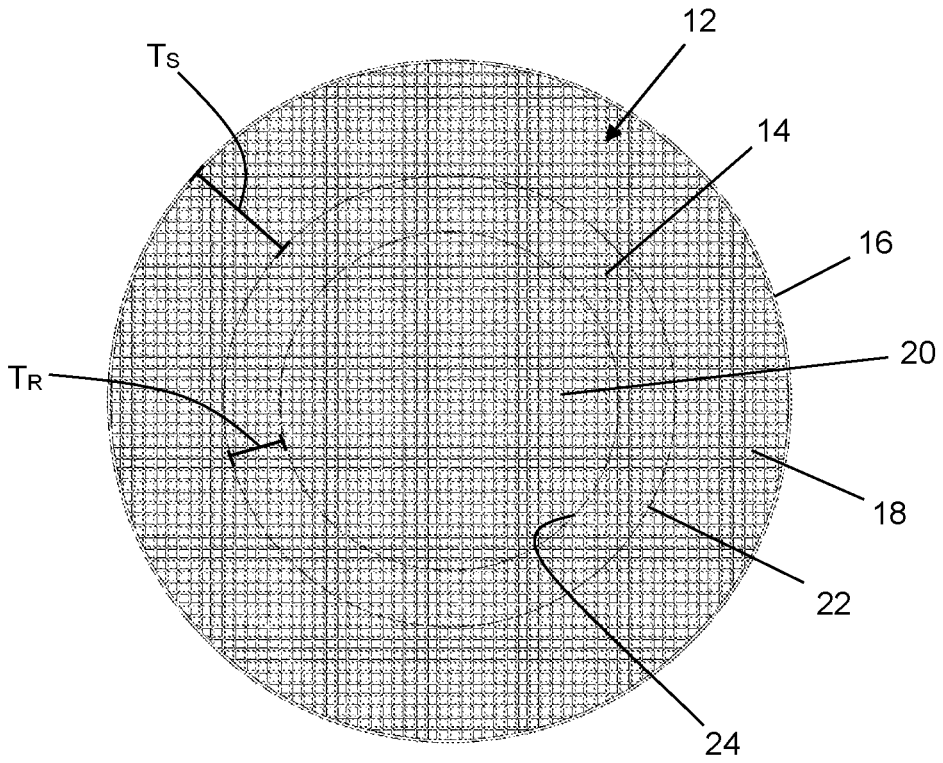
FIG. 3 is a top view of the drumhead of FIG. 1.

With reference to the drawings, disclosed herein is a first embodiment of a drumhead assembly 10 that produces a tone like that of a traditional drum at a reduced volume and feels like a traditional drum when struck with a drumstick or mallet. In its most basic form, the drumhead 10 comprises a layer of a porous material 12, such mesh, and a ring 14 of an inert compressible material attached to the porous layer 12. The compressibility property of the ring 14 imparts an ability to stretch under tension, which within the context of the inventive embodiments, allows alteration of tonal qualities and feel of the drumhead when struck. The porous layer is circular in shape 12 and is stretched across a standard circular hoop 16, as is common in the drumming arts. When the drumhead 10 is assembled and used, the ring 14 is positioned on the underside of the porous layer 12 opposite the striking side. As such, FIG. 1 shows a representative embodiment of the drumhead 10 from the underneath, while FIGS. 2 and 3 depict the drumhead 10 from different top views with the ring 14 beneath the mesh layer 12.

Figure 4:
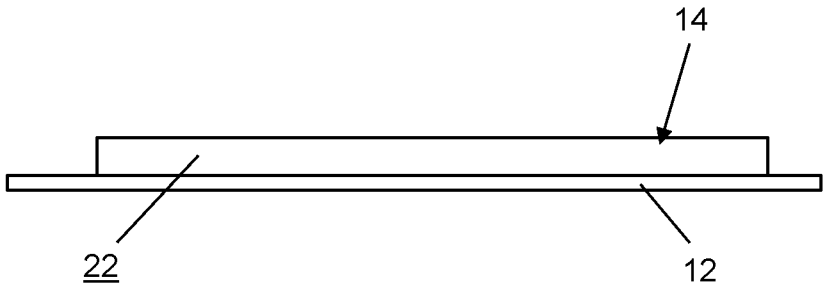
FIG. 4 is a side perspective view of the disclosed drumhead with the rim omitted for clarity.
Figure 5:
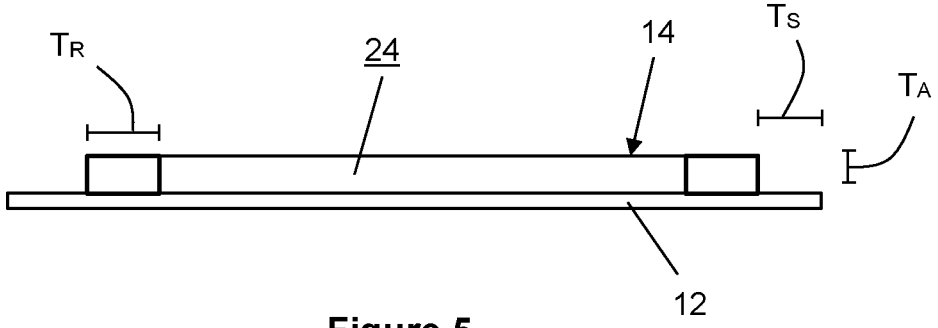
FIG. 5 is side cross-sectional view of the drumhead from FIG. 4 with rim omitted.

Preferably, the ring 14 is formed from a foam material and adhered to the surface of the porous layer 12 substantially coaxial to the porous layer 12 and drumhead rim 16. As shown most clearly in the side views of FIGS. 4 and 5, the ring 14 has a radial thickness $T_R$ between its outer edge 22 and inner edge 24 and a predetermined thickness in the axial direction $T_A$. In this embodiment, the ring 14 is positioned with spacing between its outer edge 22 and the periphery of the drumhead defined by the hoop 16, which spacing is identified with reference character $T_S$ in FIGS. 3 and 5. The inner edge 24 defines an open inner central area 20. An open outer area 18 is defined between the outer edge 22 and the outer periphery of the porous layer 12 defined by the hoop 16. In a typical use of the inventive drumhead 10, a musician would strike the mesh layer 12 in a radially-central location (somewhere within the central area 20) without a portion of the ring 14 directly beneath, defining a striking area of the drumhead 10.

The drumhead 10 is usually manufactured by first adhering the ring 14 to the layer of porous material 12 with an adhesive. The porous layer 12 is then stretched across a hoop 16 with the ring 14 in a substantially coaxial position relative to the hoop, and secured with adhesive 324 (preferably epoxy-based) along the outer peripheral edge. The stretching of the layer of porous material 12 will cause the ring 14 to stretch as well. The degree of stretching can be adjusted to impart different tonal characteristics and/or feel when striking the resulting drumhead. Alternative or additional means of attachment between the porous layer 12 and hoop 16 include all known methods of mechanical attachment. For example, in one alternate embodiment, the porous layer 12 is crimp locked with the hoop 16 without use of adhesive.

The mesh layer 12 and foam ring 14 combination can be combined with other tone shaping elements and techniques known in the musical arts. For example, coatings, printed layers and/or heat treatment can be used to adjust acoustic properties of the drumhead 10. Additionally, synthetic snare sound replicating devices or elements can be attached in combination with the porous layer 12 and ring 14. Examples of such snare replicating elements are disclosed and claimed in co-owned U.S. patent application Ser. No. 17/024,782. These snare units are formed from film materials that are attached to a drumhead and configured to vibrate against the drumhead surface when struck. Other embodiments exist that include more than one ply of porous material 12 or a composite layer of porous material as may be preferred to alter the acoustic properties and/or feel of the drumhead 10. Additionally, as discussed below, embodiments exist wherein the ring is discontinuous and includes one or more circumferential breaks with spacing (i.e., formed from multiple separate arc shaped segments).

Figure 6:
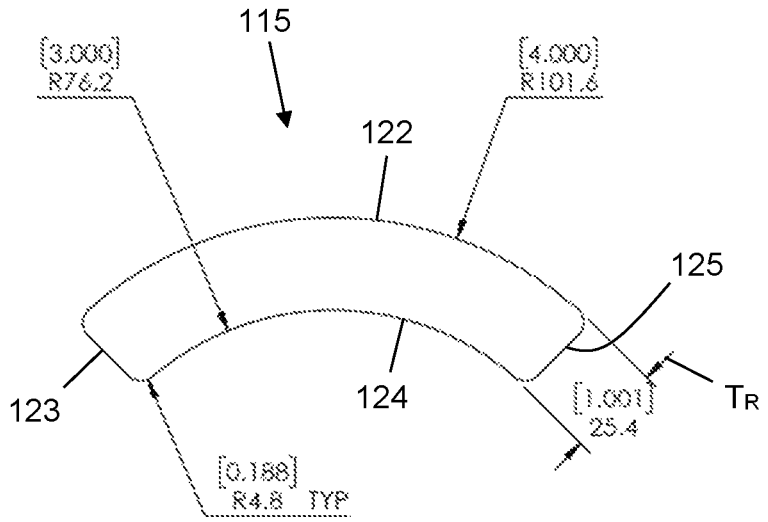
FIG. 6 shows an exemplary ring segment for use within the disclosed reduced volume drumhead.
Figure 7:
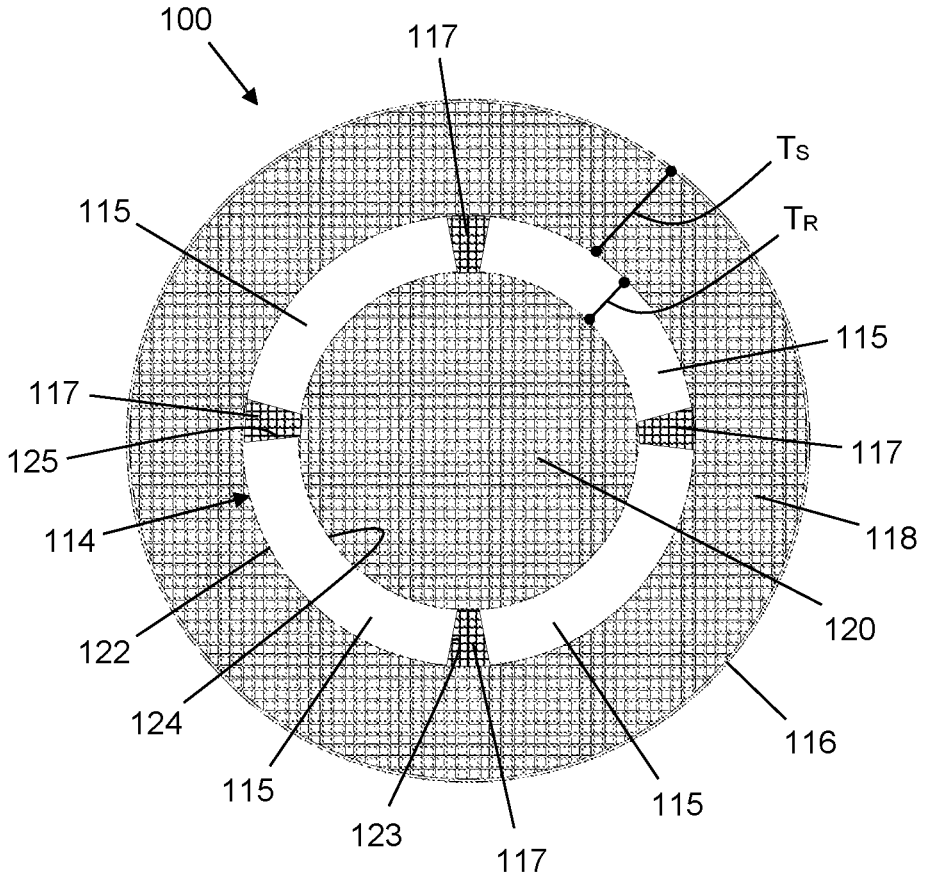
FIG. 7 shows an alternate embodiment of the drumhead that utilizes ring segments like that shown in FIG. 6.

With reference to FIGS. 6 and 7, in another embodiment, the ring 114 is formed of a plurality of arc shaped ring segments 115 with a small gap 117 between each adjacent edge of adjacent arced segments 115. This embodiment of the drumhead 100 shares many characteristics with the earlier embodiment of the drumhead 10. Like the earlier embodiments, the arc segments 115 are adhered to a layer of porous material 112 that is stretched across a hoop 116 to form the reduced volume drumhead 100.

Each segment 115 includes a radially outer edge 122 and a radially inner edge 124 defining a radial thickness $T_R$ therebetween. Rather than forming an uninterrupted ring like the earlier embodiments, each of the segments 115 extend circumferentially between a leading edge 123 and a trailing edge 125. The segments 115 are secured to the layer of porous material 112 aligned relative to one another to form a circumferentially interrupted ring 114 with spacing 117 between each leading edge 125 and the railing edge 123 of the adjacent segment 115.

Also like the earlier embodiment, the segments 115 are secured to the porous layer 112 with spacing between each outer edge 122 and the periphery of the drumhead defined by the hoop 116 (spacing is identified as reference character $T_S$ in FIG. 7). The inner edges 124 of each segment 115 face one another and combine to define an open inner central area 120, which forms a striking area for the drummer. Likewise, an open outer area 118 is defined between the outer edges 122 of the segments and the outer periphery of the porous layer 112 defined by the hoop 116.

Preferably, each segment has the same radial thickness $T_R$ and is assembled on the porous layer 112 to yield a substantially constant outer area thickness $T_S$. As shown in FIG. 7, the segments 115 in this embodiment are identical to one another and form a ring-like structure 114 with symmetrically located spacing 117. However, these features are non-limiting in that embodiments of the inventive drumhead exist with different sized ring segments and/or segments that are assembled unsymmetrically relative to each other and/or to the hoop 116.

The ring 14/114 is preferably formed from a foam, rubber or polymeric material, for example, materials selected from the non-limiting group consisting of sponge rubbers; silicone; urethanes; urethane foams, such as polyurethane foams, thermoplastic polyurethanes, expanded polyurethane and expanded thermoplastic polyurethane, expanded polypropylene, expanded polyethylene, ethylene vinyl acetate; gum rubber; rubber foams; vinyl foams; Styrofoam; cork; thermoplastic foams and thermoplastic elastomer foams. A particularly preferred material is an elastomeric closed cell polyurethane foam.

The material and configuration of the compressible ring 14/114 are selected and designed to allow it to retain a level of malleability or ability to stretch under tension. When assembled, tuning the drumhead 10/100 via traditional tuning techniques that stretch the porous layer 12/112 may stretch and vary the tension in the foam ring 14/114 to alter the tone of the drumhead when stricken. The most preferred materials combine high elasticity, tensile strength and durability with low density.

Preferably, the ring 14 is formed of a polyurethane foam material that exhibits a rebound of over 50% under ISO 8307 (ball rebound) or DIN 53512 (pendulum hammer) test conditions. Even more preferably, the material exhibits a rebound of over 55% under these test conditions.

In one embodiment of the drumhead 10/100, the foam ring 14/114 is formed of an expanded thermoplastic polyurethane, which may be Infinergy® thermoplastic polyurethane foam, manufactured and sold by BASF Corporation. In another preferred embodiment of a drumhead, the ring 14/114 is formed from a sponge rubber, which may be a natural sponge rubber material identified as Griswold 3130, manufactured and sold by Griswold LLC. A ring formed from sponge rubber has shown particular efficacy in a drumhead having a relatively larger diameter for use as a reduced volume bass drumhead. Notably, materials with relatively higher densities have shown effectiveness when used within relatively larger drumheads.

The porous layer 12/112 can be formed of any suitable material with pores that allow air to flow from the exterior to the interior of the drum when the drumhead 10/100 is struck. For example, polymer-filaments or meshes with variable pore sizes can be employed. Further, the size of the pores can be adjusted via stretching of the material layer 12/112 across the rim of a drum (i.e., tuning the drumhead). The mesh may be formed of monofilament or multifilament materials in woven, twisted, knotted, knit and/or braided configurations to form a porous mesh fabric. Additionally, the porous layer is not limited in terms of a specific orientation of fibers. Other embodiments may include multiple layers of porous material and/or film, or may include an integral layer formed as a composite between two or more different individual materials or fibers. Exemplary materials for forming the mesh layer include KEVLAR® brand and related aramid synthetic fibers and PEEK.

The exact dimensions and other configurations of the porous layer 12/112 and ring 14/114 can be adjusted as desired for different sized drumheads or to effect different acoustic properties. The radial thickness $T_R$ of the ring 14/114 with a tom drumhead is preferably within a range of approximately 0.5 inches to approximately 3.5 inches, and more preferably within a range of approximately 3.0 inches to approximately 1.0 inch, and even more preferably within a range of approximately 2.5 inches to approximately 1.5 inches. A particularly preferred embodiment for use in a 12-inch tom drumhead includes a ring 14/114 with a radial thickness of approximately 2.0 inches.

The radial thickness $T_R$ of the ring 14/114 for use within a bass drumhead is larger than that of the tom drumhead, and is preferably within a range of approximately 2.0 to approximately 6.0 inches. More preferably, the radial thickness $T_R$ of the ring for a bass drumhead is within an approximate range of 3.0-5.0 inches. A particularly preferred embodiment for use in a 22-inch tom drumhead includes a ring 14/114 with a radial thickness of approximately 4.0 inches.

The axial thickness $T_A$ of the ring 14/114 is preferably greater than approximately 0.05 inches. More preferably, the axial thickness $T_A$ is within a range of approximately 0.05 inches to approximately 0.50 inches. In a relatively smaller tom drumhead, the axial thickness $T_A$ is more preferably within a range of approximately 0.05 to approximately 0.25 inches. In a preferred embodiment for use in a 12-inch tom drumhead, the ring has an axial thickness $T_A$ of approximately 0.10 inches. In a relatively larger bass drumhead, the axial thickness $T_A$ is more preferably within a range of approximately 0.25 to approximately 0.50 inches. In a preferred embodiment for use in a 12-inch tom drumhead, the ring has an axial thickness $T_A$ of approximately 0.33 inches.

Additionally, the ring 14 may be radially sized as appropriate for a given drumhead 10/100. In a preferred embodiment, the ring 14/114 and porous layer 12/112 are sized such that a spacing $T_S$ between the outer periphery of the porous layer 12/112 and the outer edge 22/122 of the ring 14/114 is within a range of approximately 0.5 inches to approximately 6.0 inches, and more preferably within a range of approximately 1.0 inch to approximately 5.0 inches. In a relatively smaller embodiment for use as a tom drumhead, the spacing $T_S$ is more preferably within a range of approximately 2.5 inches to approximately 1.5 inches. In a particularly preferred embodiment of a 12-inch tom drumhead, the ring and porous layer are sized such that the spacing $T_S$ is approximately 2.0 inches. In a relatively larger bass drumhead, the spacing $T_S$ is preferably within a range of approximately 2.0 inches to approximately 4.0 inches. In a preferred embodiment of a 22-inch bass drumhead, the spacing $T_S$ is approximately 3.0 inches.

In use, the disclosed embodiments of the drumhead 10 and 100 with porous layer 12/112 and compressible ring 14/114 have shown remarkable results in both tone and feel when struck by a user. Musicians report that the drumhead 10/100 provides a response that accurately mimics the feel of a standard drum (high volume) as the presence of the ring 14/114 "deadens" the spring-like response associated with low volume drumheads typically formed of mesh (i.e., the "trampoline effect"). Additionally, the acoustic tone produced by striking the drumhead is remarkably like that of a traditional drum, but at a comparatively reduced volume. The inventive embodiments have shown applicability to a variety of types of drumheads, including, for example, drumheads for each of tom, snare and bass drums.

As noted above, a preferred embodiment of the drumhead 10/100 for use as a reduced volume tom has a diameter within an approximate range of 6 inches to 18 inches, and more preferably within an approximate range of 10 inches to 14 inches. As noted, a particularly preferred reduced volume drumhead for use as a tom has a diameter of approximately 12 inches.

The embodiment of the drumhead 10/100 depicted in the drawings is intended for use as a tom, however, the inventive concepts are not limited as such. For example, and as discussed above, other embodiments of the drumhead exist in larger sizes, configured for use as reduced volume bass drums. Such drumheads typically have a diameter within an approximate range of 16 inches to 26 inches, more preferably within an approximate range of 20 inches to 24 inches. A particularly preferred embodiment of a drumhead for use as a bass drum is 22 inches in diameter. Altogether, the reduced volume drumheads disclosed herein are not limited in term of particular dimensions of the drumhead/porous layer 12/112 or ring 14/114. Some preferred embodiments include arc shaped segments 115 that form a ring 114 with spacing between adjacent edges of segments.

Key dimensions of two exemplary preferred embodiments of the drumhead 100 are shown below:

Exemplary Embodiment A—Tom Drumhead

Ring material: polyurethane foam
Outer diameter of drumhead (100)/porous layer (112): 12 inches
Outer diameter of foam ring (114) formed by segments (115): 8 inches
Inner diameter of foam ring (114) formed by segments (115): 6 inches
Radial thickness of ring or each segment ($T_R$): 1.0 inches
Radial spacing from hoop ($T_S$): 2.0 inches
Axial thickness ($T_A$): 0.100 inches
$T_R$:$T_A$ ratio: 10:1

Exemplary Embodiment B—Bass Drumhead

Ring material: polyurethane foam
Outer diameter of drumhead (100)/porous layer (112): 22 inches
Outer diameter of foam ring (114) formed by segments (115): 16 inches Inner diameter of foam ring (114) formed by segments (115): 8 inches Radial thickness of ring or each segment ($T_R$): 4.0 inches Radial spacing from hoop ($T_S$): 3.0 inches Axial thickness ($T_A$): 0.333 inches $T_R$:$T_A$ ratio: 12:1

Of course, these dimensions are non-limiting to the inventive concepts described herein. As one of skill would readily understand, as the diameter of the drumhead is increased, the axial thickness $T_A$ and/or radial thickness $T_R$ of the ring is increased to provide a desired level of dampening of the trampoline effect of the porous material and desired acoustic properties. Generally, a ring with an outer diameter between 60% and 80% of the diameter of the drumhead and an inner diameter between 30% and 50% of the diameter of the drumhead has shown remarkable results within the disclosed embodiments.

Preferably, when struck, the reduced volume drumhead 10/100 exhibits a significant reduction in sound pressure level (SPL) compared to a traditional drum having the same dimensions, for example, a 12-inch reduced volume drumhead 10/100 compared to a 12-inch traditional tom drum. Embodiments of the drumhead 10/100 exhibit a reduction in SPL of at least approximately 50% compared to a traditional tom drum of the same dimension, more preferably at least approximately 60%, and even more preferably at least approximately 70% SPL reduction. In a particularly preferred embodiment, SPL is reduced by approximately 80-90% compared to a traditional tom drum of the same dimension.

Further, the reduced volume drumhead 10/100 has been shown to reduce sound level by at least approximately 5 dB, and more preferably by at least 10 dB compared to a standard tom drum of the same dimension. A drumhead like that depicted in the Figures has shown reduction in sound level relative to a traditional tom drum of the same size within an approximate range of 5-25 dB, preferably a reduction within an approximate range of 10-20 dB.

A larger version of the drumhead 10/100 for use as a reduced volume bass drum exhibits a similar comparative reduction in SPL compared to a traditional bass drum having the same dimensions, for example, a 22-inch drumhead like that shown generally as reference numeral 10/100 compared to a traditional 22-inch bass drum. Embodiments of the larger drumhead 10 for use as a bass drum exhibit a reduction in SPL of at least approximately 50% compared to a traditional bass drum of the same dimension, more preferably at least approximately 60%, even more preferably at least approximately 70% SPL reduction, and even more preferably at least approximately 80% SPL reduction. In a particularly preferred embodiment, SPL is reduced by approximately 85-95% compared to a traditional bass drum of the same dimension.

Sound level of the reduced volume bass drumhead is also reduced significantly compared to a traditional bass drum. Preferably, the sound level is reduced by at least approximately 5 dB, more preferably by at least 10 dB, and even more preferably by at least 15 dB compared to a standard bass drum of the same dimension. A bass drumhead similar to that depicted in the Figures has shown reduction in sound level relative to a traditional bass drum of the same size within an approximate range of 10-30 dB, preferably a reduction within an approximate range of 15-25 dB.

The examples below are offered for illustrative purposes to show the efficacy of the disclosed reduced volume drumhead 10/100 in forms of a tom drumhead and a bass drumhead and does not serve to limit scope of the inventive embodiments disclosed herein.

Examples

Sound characteristic measurements were taken to compare a representative reduced-volume tom drumhead like that shown in the Figures as reference numeral 10 with a 12-inch diameter ("RV" version) to a standard acoustic tom drum with 12-inch diameter ("acoustic" version). Like measurements were taken to compare a representative reduced-volume bass drumhead having 22-inch diameter ("RV" version) to a standard bass drum with 22-inch diameter ("acoustic" version). The data presented in Table 1 below was gathered from sound studies in a semi-anechoic studio environment at a distance of 6 feet and a height of 5 feet from the ground with a dBA weighted decibel reader (dBA calculated with reference sound pressure $p_0$=20 μPa).

TABLE 1

Comparative Sound Data for Reduced Volume Tom and Bass

| | dB acoustic | dB RV | SPL acoustic | SPL RV | SPL reduction (%) |
|---|---|---|---|---|---|
| Tom | 92 | 75 | 0.796 | 0.112 | 85.9% |
| Bass | 89 | 69 | 0.564 | 0.056 | 90.0% |

As reflected in the data of Table 1, the reduced volume tom drumhead 10/100 reduces sound level by 17 dB and SPL by 85.9% relative to a standard/acoustic tom drum of the same size under the testing conditions summarized above, while maintaining tonal characteristics consistent with a traditional tom drum. A drumhead for use as a reduced volume bass drum showed a reduction in sound level of 20 dB and SPL of 90.0% relative to a standard bass drum of the same size. The sound characteristics associated with the tom drumhead and bass drumhead are recognized and viewed as being sufficiently audible to be usable for performance in lower volume settings. Further, musicians report an authentic acoustic tone and a more natural feel when striking the respective drumhead as compared to known mesh drumheads.

Altogether, the disclosed embodiments of the drumhead 10/100 in a range of sizes show remarkable efficacy in providing solutions to existing problems associated with low volume drumheads that are viewed as being too quiet for many settings and standard acoustic drums that are viewed as being too loud for other settings. The disclosed embodiments provide an intermediate reduced volume drumhead that provides a natural sound at a volume that is lower than standard volume, but more audible than low volume and suitable for performance settings.

Alternate embodiments of the disclosed drumhead exist, including embodiments wherein the ring 14 has irregularities, such as one or both of the inner and outer edges having a wavy or notched configuration. Embodiments exist wherein the ring has one or more breaks in the circumference, is not a perfect ring (i.e., ovular in shape or even polygonal) and/or has different sections that vary in thickness relative to one another.

While a preferred embodiment has been set forth for purposes of illustration, the foregoing description should not be deemed a limitation of the invention herein. Accordingly, various modifications, adaptations and alternatives may occur to one skilled in the art without departing from the spirit of the invention and scope of the claimed coverage.

What is claimed is:

1. A drumhead with reduced volume, comprising:

a layer of a porous material; and a ring of a compressible material adhered to the porous material, the ring defining an open inner central area.

2. The drumhead of claim 1, wherein the ring is formed of arc-shaped segments adhered to the porous material in a ring shape.

3. The drumhead of claim 2, wherein the arc-shaped segments are positioned with space between adjacent circumferential edges of adjacent segments.

4. The drumhead of claim 1, wherein the layer of porous material is substantially circular and the ring is positioned substantially coaxial thereto.

5. The drumhead of claim 4, wherein the layer of porous material defines an outer peripheral edge and the ring is positioned radially offset from the outer peripheral edge.

6. The drumhead of claim 5, wherein the ring has an outer edge spaced from the outer peripheral edge of the layer of porous material defining an open outer annular area having a radial thickness $T_s$ within an approximate range of 0.5-6.0 inches.

7. The drumhead of claim 5, wherein the ring has a radial thickness defined between an outer edge and an inner edge, and the inner edge defines the open central area of the drumhead.

8. The drumhead of claim 7, wherein an open outer annular area of the drumhead is defined between the outer edge of the ring and the outer periphery of the layer of porous material.

9. The drumhead of claim 1, wherein the ring has an axial thickness within an approximate range of 0.05-0.5 inches.

10. The drumhead of claim 1, wherein the ring has an axial thickness $T_A$ and a radial thickness $T_R$, and the ratio of $T_R$:$T_A$ is within an approximate range of 5:1 and 25:1.

11. The drumhead of claim 1, wherein the ring is formed from a foam material.

12. The drumhead of claim 11, wherein the foam material is selected from the group consisting of sponge rubbers, silicone, urethane foams, expanded polypropylene, expanded polyethylene, ethylene vinyl acetate, ethylene vinyl acetate, gum rubber, vinyl foams, Styrofoam, thermoplastic foams and thermoplastic elastomer foams.

13. The drumhead of claim 1, wherein the ring is formed of a material selected from the group consisting of sponge rubbers, silicone, urethanes, urethane foams, expanded polypropylene, expanded polyethylene; and ethylene vinyl acetate.

14. The drumhead of claim 1, wherein the layer of porous material is circular with an outer peripheral edge and the ring has a radial thickness $T_R$ between an inner edge and an outer edge and is positioned substantially coaxial to the layer of porous material with spacing between the outer edge and the peripheral edge of the layer of porous material.

15. The drumhead of claim 14, wherein the spacing between the outer edge of the ring and the peripheral edge of the layer of porous material has a thickness $T_S$ and the ratio of $T_R$:$T_S$ is within an approximate range of 1:4 to 4:1.

16. The drumhead of claim 15, wherein the ring has a thickness $T_R$ within an approximate range of 0.5 inches to 5.0 inches.

17. The drumhead of claim 1, wherein the ring comprises at least one circumferential break with spacing between adjacent circumferential edges.

18. A drumhead with reduced volume, comprising:

a layer of a porous material stretched across a substantially circular hoop, the layer of porous material defining a first surface and second surface; and a ring of a foam material adhered to the second surface of the porous material in a position substantially coaxial to the hoop, the ring defining an open inner central area, wherein when the drumhead is struck in a location within the open inner central area, it exhibits a reduction in sound pressure within an approximate range of 50-95% and a reduction in sound level compared to a standard drumhead of the same size and shape when tested in a semi-anechoic studio environment with a dBA-weighted decibel reader.

19. The drumhead of claim 18, wherein the ring has a radial thickness $T_R$ between an inner edge and an outer edge that is within an approximate range of 0.5-5.0 inches and is positioned with spacing between the outer edge and the hoop.

20. The drumhead of claim 18, wherein the ring comprises at least one circumferential break with spacing between adjacent circumferential edges.

21. A drumhead with reduced volume, comprising:

a layer of a porous material stretched in tension and defining a first surface and second surface; and a unit of a foam material adhered to the second surface in a substantially centrally located position and defining an open central inner portion of the layer of a porous material, wherein when the drumhead is struck on the first surface in a location within the inner portion, the drumhead exhibits a reduction in sound level within an approximate range of 5-25 dB and a reduction in sound pressure within an approximate range of 50-95% compared to a standard drumhead of the same size and shape when tested in a semi-anechoic studio environment with a dBA-weighted decibel reader.

* * * * *